United States Patent [19]

Repetto

[11] Patent Number: 4,549,416

[45] Date of Patent: Oct. 29, 1985

[54] MACHINE FOR SPLITTING SKINS, HAVING AN ADJUSTABLE CALIBRATING ROLLER

[75] Inventor: Silvio Repetto, Modena, Italy

[73] Assignee: S.p.A. Luigi Rizzi & C., Modena, Italy

[21] Appl. No.: 524,297

[22] Filed: Aug. 18, 1983

[30] Foreign Application Priority Data

Sep. 10, 1982 [IT] Italy ..... 23216 A/82

[51] Int. Cl.[4] ..... C14B 1/18

[52] U.S. Cl. ..... 69/10

[58] Field of Search ..... 69/9, 10, 11, 13, 15

[56] References Cited

U.S. PATENT DOCUMENTS

| | | | |
|---|---|---|---|
| 1,382,755 | 6/1921 | Baxter | 69/10 |
| 1,814,111 | 7/1931 | Baxter | 69/13 |
| 3,109,339 | 11/1963 | Braun et al. | 69/10 X |
| 3,393,538 | 7/1968 | Mercier | 69/10 |
| 3,538,723 | 11/1970 | Imgrund et al. | 69/10 |
| 4,244,201 | 1/1981 | Repetto | 69/9 |
| 4,253,318 | 3/1981 | Repetto | 69/13 X |
| 4,441,396 | 4/1984 | Mercier et al. | 69/10 X |
| 4,444,028 | 4/1984 | Repetto | 69/13 |

*Primary Examiner*—Wm. Carter Reynolds

*Attorney, Agent, or Firm*—Karl F. Ross; Herbert Dubno

[57] ABSTRACT

The annular endless band blade splitting machine according to the invention is provided with an upper bridge having an adjustable curvature calibrating roller and with a variable cutting thickness with adjustment possible either when the machine is stopped or during the process by means of a plurality of hydraulic jacks actuated by mechanical and hydraulic servocontrol devices, which jacks support a plurality of compensating rollers leaning against the calibrating roller.

8 Claims, 6 Drawing Figures

MACHINE FOR SPLITTING SKINS, HAVING AN ADJUSTABLE CALIBRATING ROLLER

FIELD OF THE INVENTION

The present invention relates to a machine for splitting skins through their thickness in order to obtain two separate sheets, respectively the "flower" and the "crust".

BACKGROUND OF THE INVENTION

In a splitting machine means can be provided for varying the cutting thickness either uniformly over the whole skin or with different thicknesses in each area, corresponding to different characteristics of the skin to be processed.

These variations can be preliminarily prearranged or can be effected during the splitting process by manual control or according to a prearranged program.

Various types of splitting machines are known in which it is possible to regulate the splitting thickness of the "flower" side of the skin by displacing both the feed rollers and the band blade in order to take into account certain specific parameters necessary for the correct cutting of the skin.

Such known machine can have a rigid supporting frame or bench, to which are fitted two horizontal bridges, a lower horizontal bridge carrying a rubberized feed and pressure roller as well as a ring roller in contact with the "flesh" part of the skin, and an upper horizontal bridge carrying a calibrating roller for feeding and for regulating the cutting thickness, there being disposed between the two bridges a longitudinal bench supporting and guiding the band cutting blade which is tensioned between two lateral flywheels disposed at the ends of the bench.

In splitting the skins the problem arises of obtaining different splitting thicknesses of the "flower" side of the skin, in order to have a greater thickness where the skin is of a lower strength, as in the case of the flanks or of the neck, and a lesser thickness where the skin is tougher as on the back and on the paws. It is necessary to cause the calibrating roller to assume a curved profile, in the direction of its length, and to vary said curvature and the cutting thickness during the splitting processing.

Machines are known which allow the lifting of the ends of this roller, but these known machines offer a limited possibility of regulating the curvature, since it is impossible to adjust it at every point of the skin to be split.

OBJECT OF THE INVENTION

The object of the invention is to provide a machine which allows thickness regulation at every point of the skin to be split, causing the calibrating roller to assume the most suitable curvature and simultaneously regulating the splitting thickness during the processing.

SUMMARY OF THE INVENTION

More specifically, the invention provides a machine for splitting skins through their thickness, with an annular endless band blade, having an upper bridge carrying a power-driven calibrating roller and a lower bridge having a rubberized feed and pressure roller coupled to a ring roller, the rollers in turn being in contact respectively with the "flower" side and the "flesh" side of the skin, the upper bridge being displaceable for the regulation in a direction parallel to the plane of the band blade with a swinging around upper hinges supporting the upper bridge. The calibrating roller is vertically adjustable and can be warped by flexure.

I also provide a plurality of compensating rollers acting against the calibrating roller, the compensating rollers being supported by a plurality of bearing means displaceable by hydraulic actuators, the bearing means supporting also the calibrating roller at its ends, and means for regulating the position of the actuators being provided, either separately or together, when the machine is stopped and during the splitting of each skin.

According to an embodiment of the invention, each compensating roller is supported at its ends by a pair of hydraulic actuators. According to a different embodiment of the invention, the compensating rollers are supported by two half-beams supported at their ends by these actuators. The actuators are controlled by servocontrols having hydraulic and mechanical operating means, the servocontrols acting on the shutting member of the controlling valves of each actuator. The mechanical means operating said servocontrols consist of a transverse shaft having worm segments, each of the segments being engaged with a gear wheel connected by a screw-internal thread coupling to an axially movable vertical shaft acting on the shutting member of one of the valves, said transverse shaft being rotatable about is axis and axially movable by controlling means.

The hydraulic operating means of the servocontrols consist of pistons, each of them connected to a vertical shaft acting on a shutting member of one of the controlling valves of the actuators. Each of the controlling valves of the actuators is housed within the piston of an actuator itself. The transverse shaft is axially movable by means of an hydraulic cylinder-piston unit, the shaft being rotatable but not translatable with respect to the piston.

Means for counting the revolutions of the transverse shaft can be provided, which means can display and control the vertical displacement of the hydraulic actuators. In an embodiment of the invention means for preselecting consecutive thickness, curvature and splitting speed combinations of each skin are provided, which means allows transition in succession from one speed combination to the following one during the splitting process.

BRIEF DESCRIPTION OF THE DRAWING

For a better understanding of the characteristics of the invention, reference is made to the accompanying drawing in which.

SPECIFIC DESCRIPTION

Figure 1:
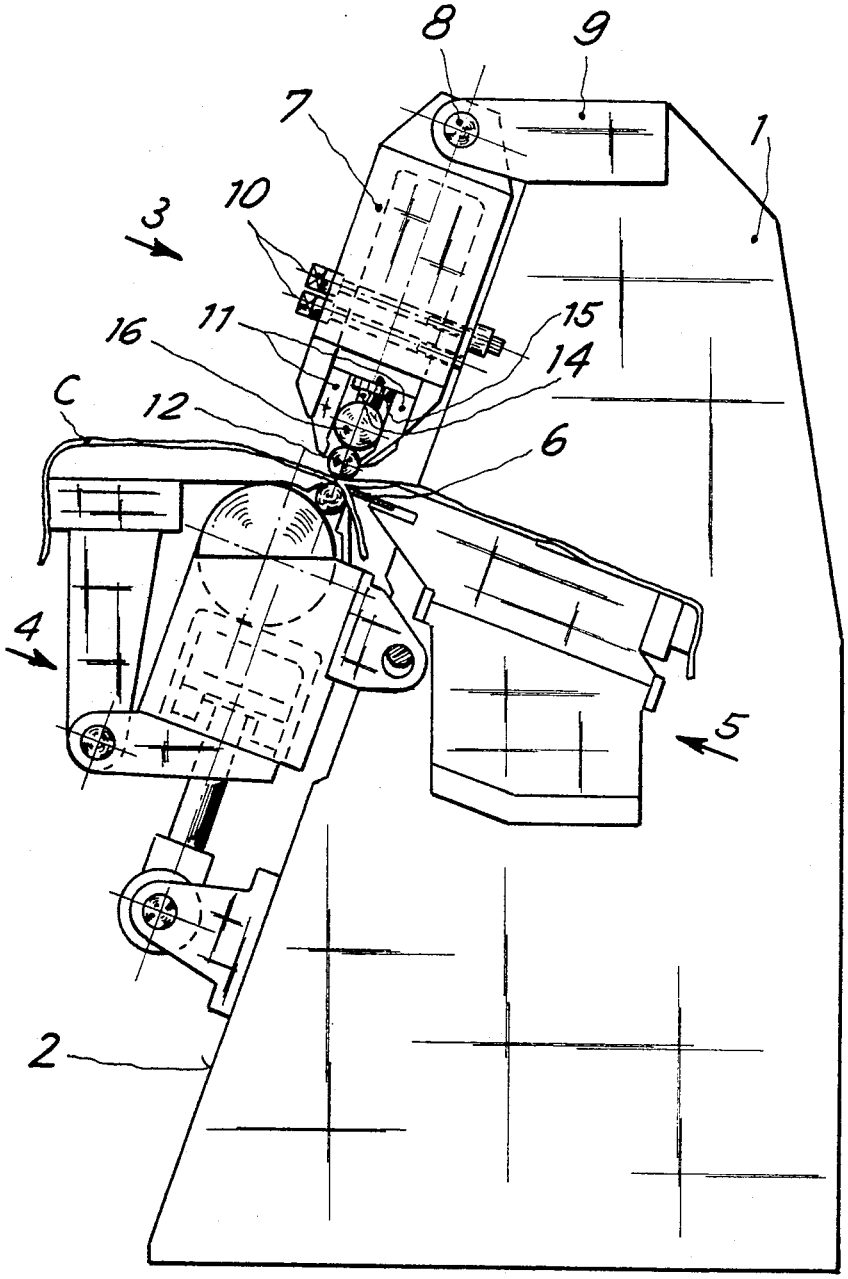
FIG. 1 is a diagrammatic side view of the machine.

Referring to FIG. 1, the machine comprises two lateral cheek plates 1 forming a rigid frame having a substantially planar front face 2 inclined upwardly towards the rear, to which are fitted the working members, viz. an upper bridge generally indicated at 3 and a lower bridge generally indicated at 4. Both of these members are inclined substantially parallel to the front face 2 of the cheek plates 1. Between the cheek plates 1 there is disposed a longitudinally extending bench generally indicated at 5, which in turn extends rearwardly and downwardly and possesses an upper working surface substantially perpendicular to the inclined front face 2.

The functions of said three members, i.e. the upper bridge 3, the lower bridge 4 and the longitudinal bench 5, are already known on the whole in splitting machines for skins using an endless band blade. Basically, the upper bridge 3 fulfills the function of reacting to the pressure exerted upon the skin C being processed and of driving the upper face of same, the lower bridge 4 fulfills the function of exerting a pressure upon the skin C from below and of driving same onto the cutting blade, and the longitudinal bench 5 holds in position the upper run of the cutting blade 6, which is shaped in known manner as a closed or continuous band and is tensioned between two lateral flywheels which cause the blade itself to travel at the cutting location in the longitudinal direction while maintaining the continuous band in a plane substantially perpendicular to the direction of feed of the skin C.

Also in a known manner, the cutting blade 6 is continuously sharpened before arriving at the cutting location, by means of known equipment not shown here, and consequently it is continually reduced in its transverse dimension in relation to the wear to which it is subjected. The take-up of the wear of the blade is furthermore effected by known means, omitted here in order to simplify the drawing.

Further particulars concerning the characteristics of a known splitting machine can be gathered from U.S. patent application Ser. No. 321,617 filed Nov. 16, 1981 now U.S. Pat. No. 4,444,028 issued Apr. 24, 1984.

More specifically, according to the present invention the upper bridge 3 consists of a beam 7, hinged at the top at 8 to the supporting members 9. The position of the beam 7 can be adjusted in a direction substantially parallel to the plane of the blade 6 by means of the screws 10.

At the lower end of the beam 7 there are disposed the parallel guides 11 for containing the power-driven or idler calibrating roller 12 coating with a feed and pressure roller of lower bridge 4.

Figure 2:
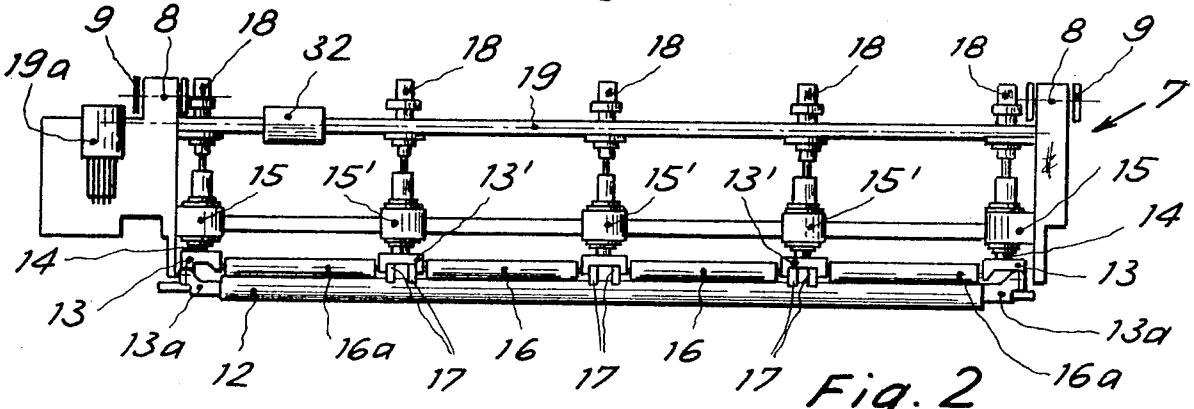
FIG. 2 is a detail view of the upper bridge of the machine according to a first embodiment.

As shown in FIG. 2, the roller 12 is journaled at its ends by the hinge supporting members 13*a*, hingedly connected to their supporting blocks 13. The supporting blocks 13 are arranged at the ends of the shanks 14 of a pair of hydraulic jacks 15. Against the roller 12 are arranged the compensating rollers 16 and 16*a* having the function of bracing the roller against and thereby preventing the flexure of the roller 12 during the splitting of the skin. The rollers are provided in a number depending upon the total length of the calibrating roller 12, in order to assure the rigidity thereof, with the desired profile, during the processing.

The rollers 16*a* are supported at their ends by the blocks 13 and 13′ mounted on the shanks 14 of the end hydraulic jacks 15 and the middle jacks 15′. The lateral rollers 16*a* have their ends placed at the two ends of the beam 7 supported by the same blocks 13 supporting the roller 12.

Advantageously, on the blocks 13′ there are furthermore arranged magnets 17, which prevent the flexure (sag) of the roller 12, under the effect of its weight, when the opposing action of the skin during the splitting processing is reduced. The jacks 15 and 15′ are supported by the beam 7 and are controlled by the servocontrol units 18. The servocontrol units 18 are provided with two separate stroke-controlling members, one of mechanical type actuated by the shaft 19, only the axis line of which is shown in FIG. 2, and the other of hydraulic type by means of an auxiliary piston 38, both acting on the distributor valve 20 of each jack.

Figure 3:
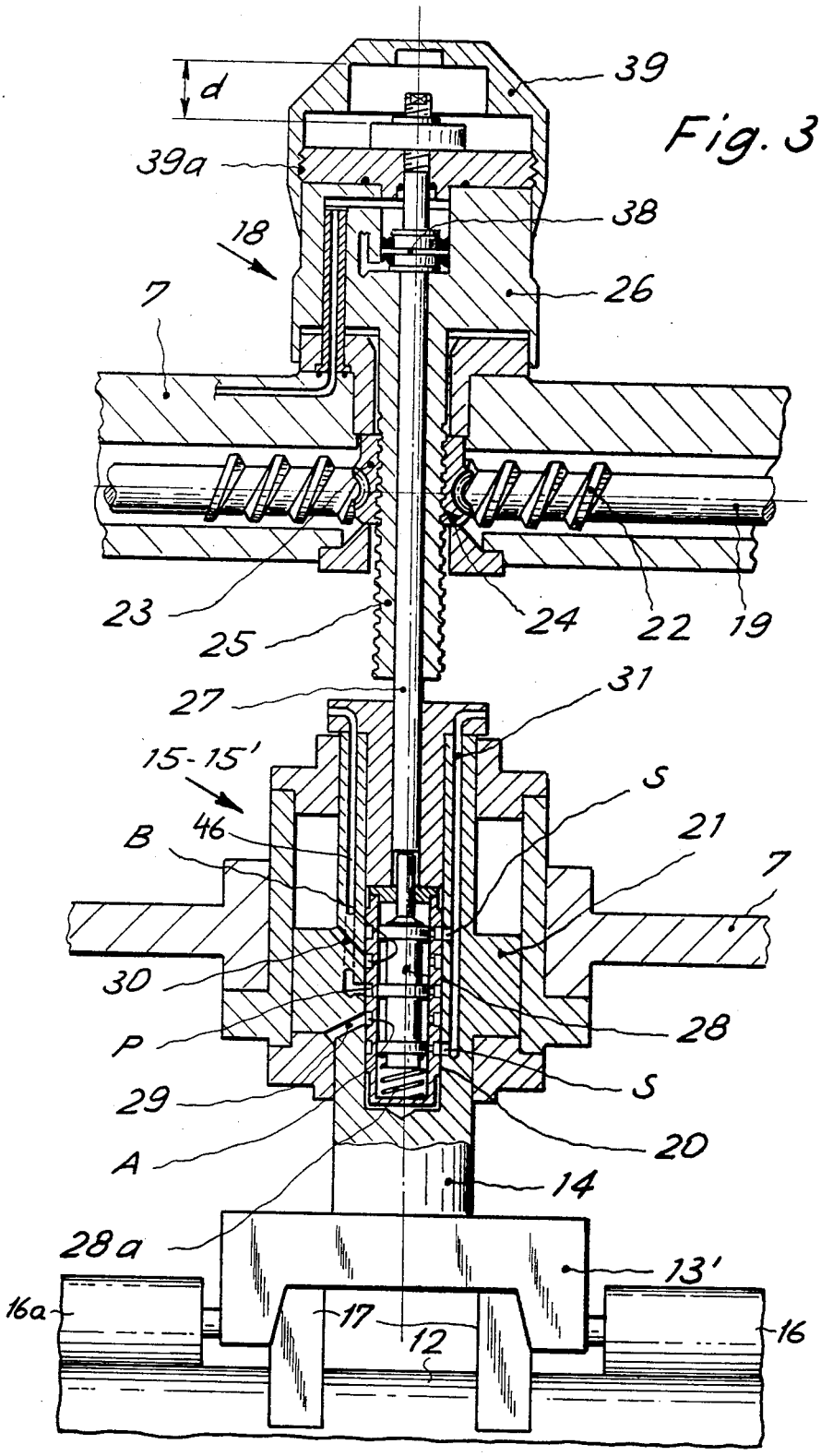
FIGS. 3 and 4 are two sectional views of an actuator provided with servocontrol devices.

As shown in FIG. 3, the mechanical control of the stroke of the piston 21 of each jack 15 and 15′ is effected by the worm segment 22 of the shaft 19. The worm segment is positioned in correspondence to each servocontrol 18 and couples with the gear wheel 23. The gear wheel 23 is provided with a thread 24 on its inside, engaged with the shaft 25 of the servocontrol 18. The shaft 25 is vertically movable together with the body 26 of the servocontrol 18 and draws in its movement the shaft 27 acting on the shutting or valve member 28 of the distributor valve 20. The shutting member 28, displaced from its central position under the rotary action of the shaft 19 moved by the motor reducer unit 19*a* (see FIG. 2) for example with an upward movement, assisted by the spring 28*a*, puts into communication the pressurized fluid feeding port P connected with its feeding duct 46 to which a fluid pressure is applied with the port A connected by the duct 29 to the lower face of the piston 21, inside which the valve 20 is situated, and the port B connected to the upper face of the piston 21 by the duct 30, and the ports S connected to the exhaust duct 31. The piston 21 therefore moves with a stroke equal to the displacement given to the shutting or valve member 28, re-establishing the equilibrium condition.

The regulation is common to all the valves controlling the jacks and allows to regulate in advance the position of the calibrating roller with respect to the skin to be split, determining the average splitting thickness.

A rapid variation of the splitting thickness can also be obtained during the splitting processing by means of an axial displacement of the shaft 19, which therefore causes the rotation of the gear wheels 23 and the displacement of the servocontrol 18, as previously described.

Figure 4:
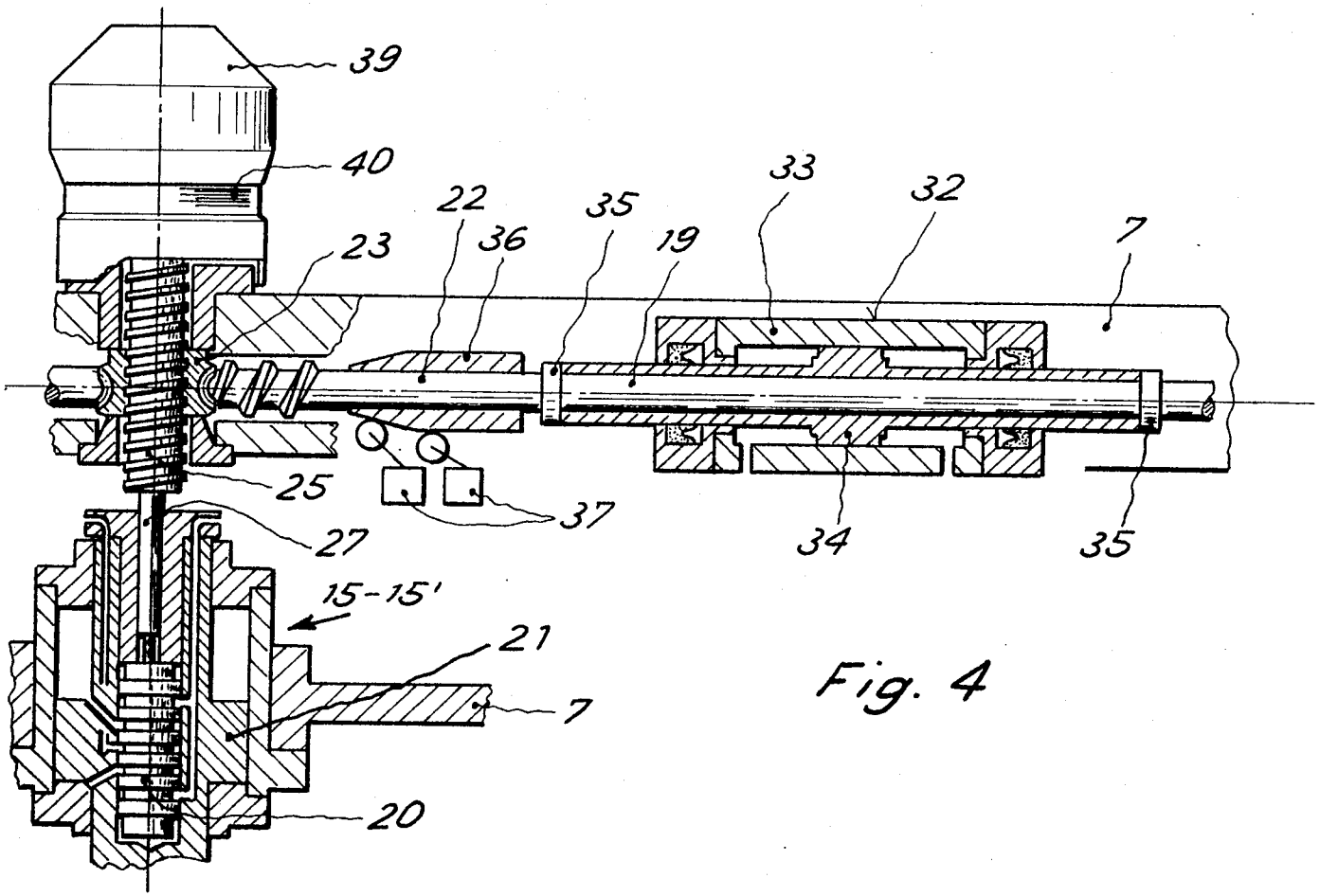

The axial displacement of the shaft 19 is operated by the hydraulic unit 32, shown in detail in FIG. 4.

The hydraulic unit 32 consists of a cylinder 33, mounted on the beam 7, inside which the hollow piston 34 slides.

The shaft 19, which is free to rotate but is axially locked with respect to the piston 34 by the rings 35, passes through the piston 34 itself.

One or more cams 36, integral with the shaft 19, allow an automatic control of the displacements of the shaft 19, corresponding to predetermined splitting thickness increases, by operating one or more limit switches 37.

The hydraulic servocontrol of the distributor valve 20 consists (as shown in FIG. 3) of the auxiliary piston 38, which is directly connected to the shaft 27 acting on the shutting member 28 of the valve 20. The stroke of the auxiliary piston 38 is adjustable by the rotation of the ferrule 39, forming the upper cover of the servocontrol 18, vertically displaced by virtue of the thread 39*a*, and which displays the regulation graduated scale 40 (see FIG. 4).

The free sliding distance "d" of the piston 38 can be therefore regulated, so achieving the possibility of modifying, by acting on each point of the calibrating roller 12, the splitting thickness in order to make it suitable, during the splitting processing of each skin, in accordance with the different characteristics of each area.

In fact, it is possible to execute a splitting processing so as to obtain a skin having greater thicknesses in more tender areas such, as the abdomen and the neck, and reduced thicknesses in the higher strength areas, as the paws and the back, by modifying the thickness during the splitting process.

The presence of an appropriate number of compensating rollers 16 and of jacks 15 in relation to the total length of the beam 7 and therefore of the calibrating roller 12 allows the roller 12 to assume the more suitable profile, either with a concave curvature or with a convex curvature, compatable with the capability of the roller 12 itself to being warped.

Whenever it is not necessary, in relation to the kinds of skins to be processed, to obtain a regulation of the thickness involving several thickness variations, and it is sufficient to act on the lateral jacks in order to cause the increase or decrease of the required thickness on the flanks, it is possible to reduce the number of the jacks employed to a central and two lateral ones. In this case, owing to the required higher length of the compensating rollers 16, it will be necessary to provide an appropriate increase of their diameter or preferably (as shown in FIG. 5), to replace them by a pair of half-beams 41, on which more compensating rollers 42, having reduced length and diameter, are disposed.

Figure 5:
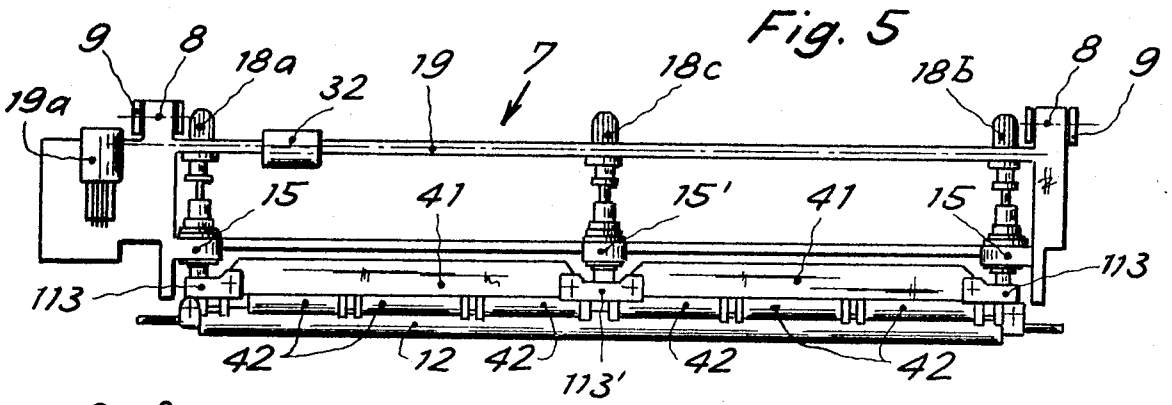
FIG. 5 is a detail view of the upper bridge of the machine according to a second embodiment.

With the embodiment shown in FIG. 5, in which the same numerical references of FIG. 2 for the common elements have been employed for identical elements and similar numerals in the hundreds series for similarly functioning elements, it is sufficient that only the end servocontrol units 18*a* and 18*b* carrying end blocks 113 be provided with a hydraulic servocontrol for determining the thickness on the flanks and therefore the curvature assumed by the calibrating roller 12. The central jack 18*c* carrying supporting block 113' allows the regulation of the average splitting thickness by mechanical servocontrol.

In order to obtain a sufficiently uniform curvature profile for the calibrating roller 12, a regulation of the position of the members supporting the compensating rollers 42 can be provided so they may correspond to the average working curvature of the roller 12 itself.

Figure 6:
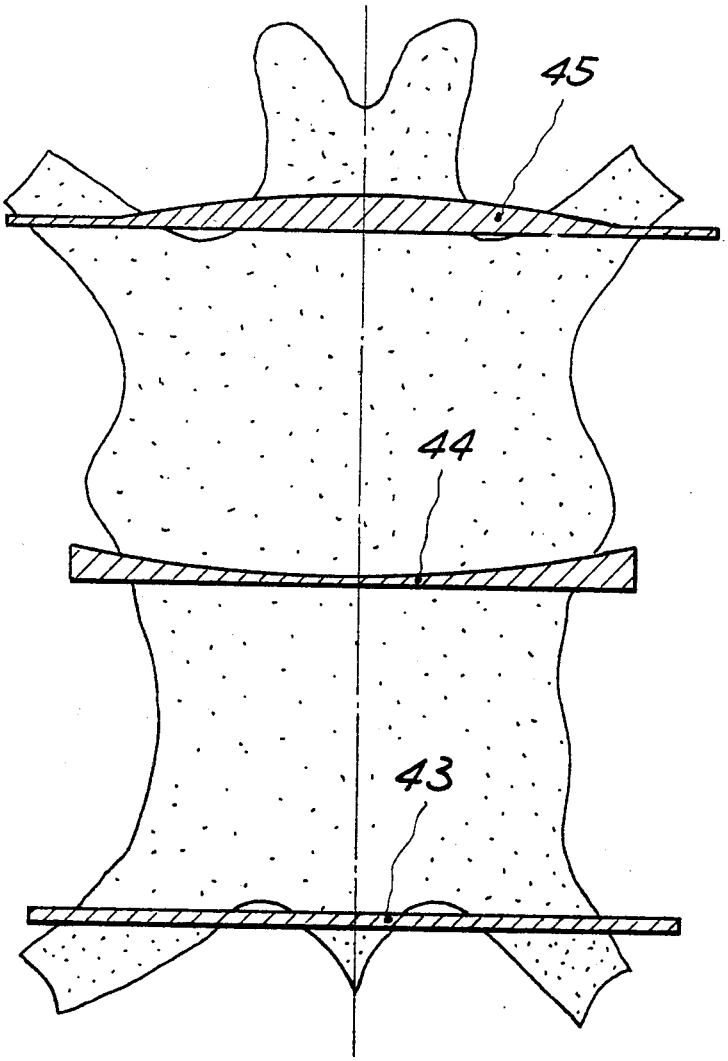
FIG. 6 is a diagrammatic view of a skin with different splitting thicknesses.

As shown in FIG. 6, it will be therefore possible, by means of the machine according to the invention, to execute a constant thickness splitting of the hind area of a skin, as shown by the section 43, with a low advancing speed in order to facilitate the introduction thereof into the machine. It will then be possible to execute a concave section splitting of the middle area of the skin, as shown in 44, with a high advancing speed and a convex section splitting 45 of the fore area of the skin corresponding to the neck at the highest advancing speed, it being furthermore possible to provide an increase of the average splitting thickness.

The cutting, thickness, curvature and advancing speed parameters can be selected in advance for each kind of skin to be processed and can be stored, by a series of selectors or by an electronic storage unit.

The processing can then be executed by recalling in sequence, in correspondence to each area of the skin, the selected cutting parameters, so allowing an easy and accurate handling by the operator.

Numerous variations can be provided, according to the use requirements, without however departing from the scope of the present invention. For the person skilled in the art it will furthermore be possible to utilize various known solutions in order to realize all those parts of the machine, as the frame, the power-driving means, the hydraulic and electric circuits, which have not been described in detail in the present specification.

I claim:

1. In a machine for splitting skins through their thickness, with an annular endless band blade, an upper bridge carrying a power-driven calibrating roller and a lower bridge having a feed and pressure roller, said rollers in turn being in contact respectively with a flower side and a flesh side of a skin, said upper bridge being swingable on upper hinges supporting the upper bridge on a machine support, the improvement wherein said calibrating roller is vertically adjustable and can be warped by flexure and a plurality of compensating rollers are provided to act against said calibrating roller, said compensating rollers being supported by a plurality of bearing means displaceable by hydraulic actuators, said bearing means including two bearing means supporting said calibrating roller at its ends and at least one bearing means between said ends, means being provided for the regulation of the positions of said actuators individually and jointly when the machine is stopped and during the splitting processing of each skin.

2. The improvement defined in claim 1 wherein each compensating roller is supported at its ends by a pair of said hydraulic actuators.

3. The improvement defined in claim 1, wherein said compensating rollers are supported by two half-beams supported at their ends by said actuators.

4. The improvement defined in claim 1 wherein said actuators are controlled by servocontrols having hydraulic and mechanical operating means, said servocontrols each including a controlling valve of the respective actuator having a respective shutting member the position of which regulates the respective actuator.

5. The improvement defined in claim 4 wherein said mechanical operating means of said servocontrols comprises a transverse shaft having worm segments, each of said segments being engaged with a gear wheel connected by a screw-internal thread coupling to a vertical axially movable shank acting on the respective shutting member of one of said valves, said transverse shaft being rotatable about its axis and being axially movable by controlling means.

6. The improvement defined in claim 4 wherein said hydraulic operating means of said servocontrols comprises pistons each connected to a vertical shaft being on a respective shutting member of one of said controlling valves.

7. The improvement defined in claim 4 wherein each of said controlling valves of said actuators is housed inside the piston of the respective actuator.

8. The improvement defined in claim 5 wherein said transverse shaft is axially movable by means of an hydraulic cylinder-piston unit, said shaft being rotatable and not translatable with respect to a piston of said unit.

* * * * *